United States Patent [19]

Kuna et al.

[11] 4,292,758

[45] Oct. 6, 1981

[54] JET TOY BOAT

[75] Inventors: Wayne A. Kuna, Oak Park; James G. Thibault, Chicago; Palmer J. Schoenfield, Evanston, all of Ill.

[73] Assignee: Marvin Glass & Associates, Chicago, Ill.

[21] Appl. No.: 116,928

[22] Filed: Jan. 30, 1980

[51] Int. Cl.[3] ..... A63H 23/02

[52] U.S. Cl. ..... 46/93

[58] Field of Search ..... 46/93–96, 46/92, 91

[56] References Cited

U.S. PATENT DOCUMENTS

| | | | |
|---|---|---|---|
| 1,691,189 | 11/1928 | Hall | 46/92 |
| 2,101,646 | 12/1937 | Gordon | 46/95 |
| 2,233,693 | 3/1941 | Clarke | 46/93 |
| 2,628,451 | 2/1953 | Goldfarb | 46/93 |
| 3,126,669 | 3/1964 | Gausewitz | 46/93 |
| 3,229,419 | 1/1966 | Fry | 46/92 |
| 3,246,419 | 4/1966 | Pawelka et al. | 46/95 |
| 3,721,038 | 3/1973 | Viczena | 46/93 |

FOREIGN PATENT DOCUMENTS

| | | | |
|---|---|---|---|
| 193769 | 6/1957 | Fed. Rep. of Germany | 46/95 |

*Primary Examiner*—Gene Mancene
*Assistant Examiner*—Michael J. Foycik
*Attorney, Agent, or Firm*—Mason, Kolehmainen, Rathburn & Wyss

[57] ABSTRACT

A manually operable buoyant tub toy simulating a jet powered boat or boat dashboard includes a manually operable air bubble and wake generator, a manually operable bow spray generator and a sound generator responsive to rotation of a steering wheel. A floodable compartment located under a hatch in the deck of the toy boat has a transparent top wall and contains miniature simulations of various aquatic life forms. A manual handle located toward the rear of the toy boat is suitable for carrying the toy boat or propelling it through the water. Functional or simulated nautical instruments and implements such as a compass, a speedometer, and horn are provided on the toy boat.

1 Claim, 4 Drawing Figures

11
12
15
16
21
22
23
25
2
3
4
31
32
38
41
51
52
53
74
75
77
78
112
17
18
18a
19
20
26
122

12
13
15
16
17
50
51
52
53
54
55
56
57
58
61
62
70
71
72
73
74
75
76
77
78
81
82
83
84
85
86
87
91
92
93
94
95
101
103
107
111
112
122
13a 13
16
17
31
32
33
34
35
36
37
38
41
104
107
121
122
13a 13
14
13a
101
102
103
104
105
106
107
111
121
122
131
132
19
20

JET TOY BOAT

BACKGROUND OF THE INVENTION

The present invention relates generally to a toy boat and more particulary to a toy boat suitable for play in shallow, confined bodies of water. The toy boat is provided with means corresponding to or simulating nautical instrumentation and implements associated with boats and with means for simulating some of the visual and audible phenomena incident to the operation of boats.

DESCRIPTION OF THE PRIOR ART

Numerous toys resembling ships and boats suitable for children playing in shallow water are known. Such toys appeal to a child's imagination, their sense of make-believe and may also provide an opportunity for manual or other physical exercise and training of children. the attractiveness of such toys depends largely upon the degree of resemblance in appearance and function which the toy bears to the utilitarian object which the toy resembles. There is consequently a significant need and demand for new and improved toys, particularly toy boats allowing children to play in water and to imitate some of the visual and audible effects associated with functional boats.

SUMMARY OF THE INVENTION

The present invention relates to a buoyant toy which resembles a power boat, particularly the console or instrument panel including a speedometer and a compass, with a considerable degree of realism. The stern of the toy boat includes rearwardly directed air tubes normally immersed in water and communicating with an air bulb, compression of which will produce a stream of bubbles in the wake. Water spray generating apparatus is provided and comprises a water reservoir which communicates through a suitable tube with a nozzle located at a depressed well in the deck. The reservoir may be charged with water from said depressed well and may be compressed to eject water through the nozzle to simulate bow spray. The toy boat also is equipped with a marine life observation compartment under a hatch hingeably mounted on the deck of the toy boat. The compartment contains miniature models of marine life and is provided with water inlets in the bottom wall to flood the compartment when the toy boat is waterborne. The compartment is equipped with a pinhole or a suitable air valve to provide for convenient displacement of the water from the compartment upon the removal of the toy boat from the water as well as for the convenient escape of air from the compartment when the toy boat is placed in the water. The top wall, and optionally the bottom wall, of the compartment are made of transparent material to facilitate observation of the miniature marine life forms which will float in water admitted to the compartment through the inlets.

Also mounted topside the toy boat is a horn which emits audible signals upon rapid manual compression of an air bulb associated therewith.

The toy boat is further provided with an upstanding housing carrying a rotatable simulated steering wheel having a central shaft within said housing. A sound generator is provided within said housing and includes a pair or radial blades affixed to the central shaft and a flexible reed having one free end projecting within the radius of travel of said pair of blades so as to generate a series of audible sounds when the free end of the flexible reed is struck by the blades rotating with the shaft of the simulated steering wheel as it is turned.

Toward the stern of the toy boat a handle is provided by which the toy may be conveniently and safely carried or manually pushed through the water if desired.

Other objects, features and advantages of the invention will be apparent from the following detailed description taken in connection with the accompanying drawings.

DETAILED DESCRIPTION OF THE PREFERRED EMBODIMENT

Figure 1:
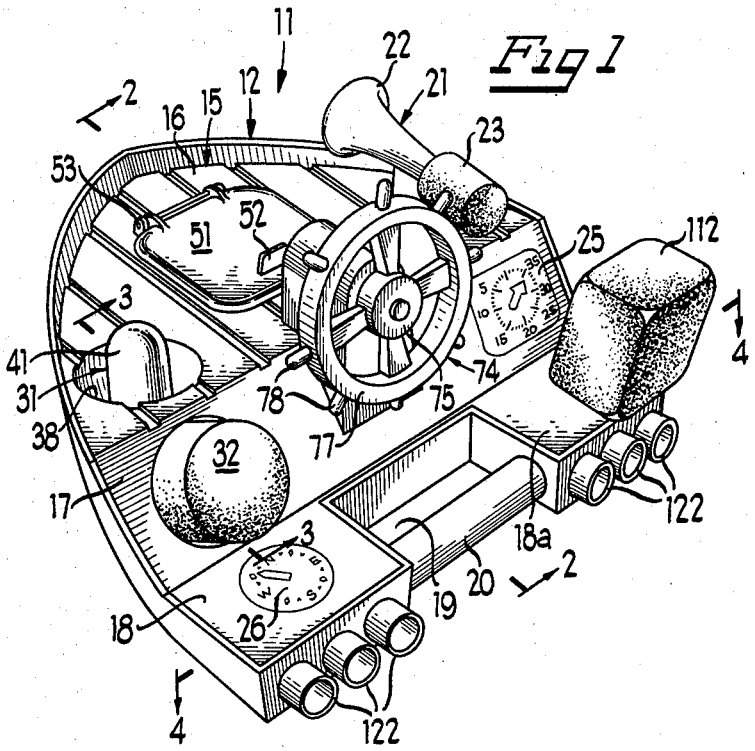
FIG. 1 is a perspective view of a jet boat made in accordance with the concepts of the present invention.

The toy boat generally denoted as 11 has a preferably integrally molded hull 12 which comprises a flat bottom 13 having a pair of upwardly slanting rearward extensions 13*a* and a continuous upstanding side wall 14. The hull 12 is topped by a deck 15 similar to a quarterdeck which is also preferably integrally molded, and comprises three different levels namely the elevated front deck 16, the downwardly slanting intermediate portion 17 and a pair of rectangular, laterally spaced low level rear extensions 18 and 18*a*. The hull 12 conforms to extensions 18 and 18*a* to define a rectangular central well 19 at the stern of the hull. The well 19 is spanned by a cylindrical handle 20 suitable for carrying the toy boat safely and for pushing it through water.

The front deck 16 carries a horn 21 having a mouth 22 and an air bulb 23 which may be manually compressed to generate audible sound. A simulated speedometer 25 is mounted or depicted on the right-hand side of deck portion 17 and a simulated compass 26 is mounted or depicted on deck extension 18.

Figure 3:
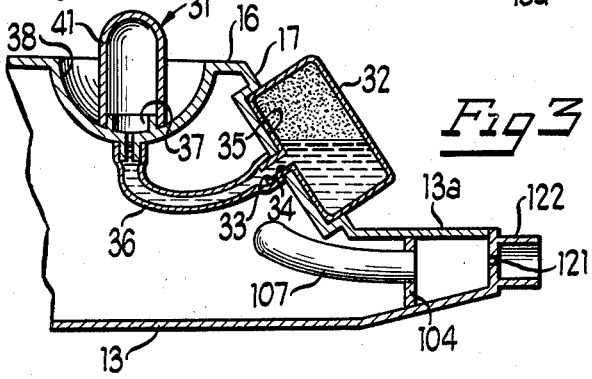
FIG. 3 is a fragmentary vertical sectional view taken generally along line 3—3 of FIG. 2.
Figure 4:
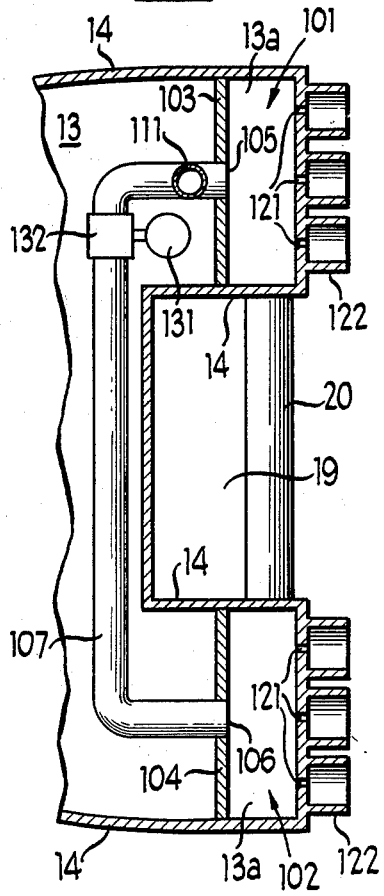
FIG. 4 is a fragmentary horizontal sectional view taken generally along line 4—4 of FIG. 1.

The toy 11 is provided with a bow spray generator generally identified as 31 and best shown in FIG. 3. A compressible bladder 32 serving as a water reservoir is mounted in a recess 35 provided in deck portion 17 and has a nipple 33 which extends through an aperture 34 below deck 17. An elastic tube 36 fits tightly over nipple 33 and extends through the interior of boat 11 to a spray nozzle 37 provided in a semi-spherical depression 38 in deck portion 16. A dome shaped cap 41 may be removably placed over nozzle 37 when spray generator 31 is not in use and may also serve as a vessel for loading water into well 38. Water contained in well 38 flows into bladder 32 when the manually compressed bladder returns to its normal configuration upon release of manual pressure. Conversely water contained in bladder 32 may be ejected, by manual compression of the bladder through nozzle 37 to simulate bow spray.

Figure 2:
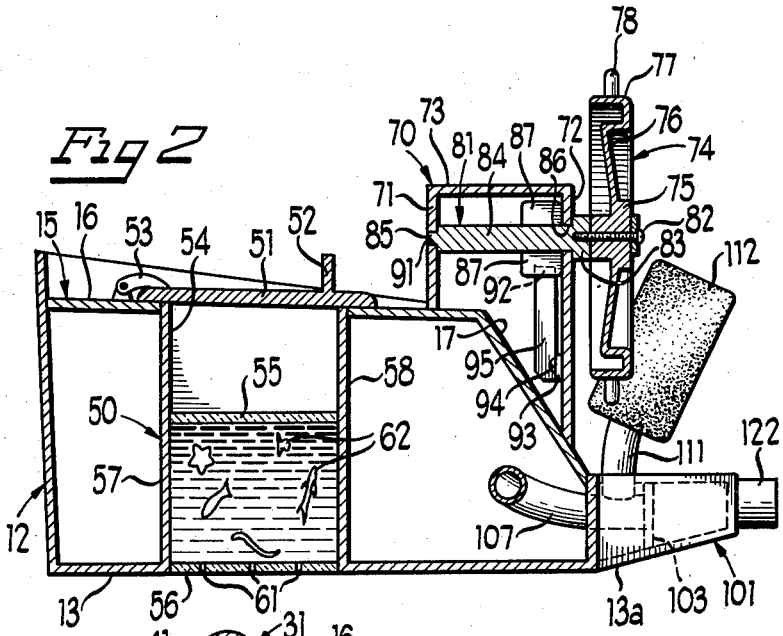
FIG. 2 is a vertical sectional view taken generally along line 2—2 of FIG. 1.

As best shown in FIG. 2 a marine life observation compartment generally denoted as 50 is provided under hatch 51. The hatch 51 is mounted on deck portion 15 by hinge means 53 and is generally square, bears a handle 52 at one end and covers an aperture 54 in deck portion 15. Compartment 50 is defined by a generally square transparent top wall 55 and a similar bottom wall 56, a front wall 57, a rear wall 58 and side walls which are not specifically shown in the drawing. A plurality of water inlets 61 are provided in bottom wall 56 to permit water to enter compartment 50 when toy 11 is placed into water. Various buoyant miniature bodies 62 visually representing specimens of marine life are contained in compartment 50 and may be viewed from above when hatch 51 is open. A pinhole, not shown in the drawing, or other suitable valve means known to those skilled in the art is provided in top wall 55, to permit the escape of air from compartment 50 and the influx of air into compartment 50 as may be needed to respectively flood or drain the compartment.

A housing generally denoted as 70 having an upstanding front wall 71 mounted on deck portion 16 and an upstanding rear wall 72 mounted on deck portion 17 and a cover 73 in the shape of an inverted U is mounted approximately midship. Outside housing 70 and spaced from rear wall 72 is a simulated nautical steering wheel 74 having a central hub 75 from which a plurality of spokes 76 radiates toward a rim 77 surrounded by handles 78. A central shaft 81 extends forward from hub 75 and is journaled in housing 70. In the embodiment shown in FIG. 2 shaft 81 and steering wheel 74 are joined by a screw 82, but may be integrally molded to minimize assembly costs.

The central shaft 81 has three longitudinal segments 83, 84 and 85 of varying diameters. Segment 83 has the largest diameter and projects rearwardly from rear wall 72. Segment 84 of central shaft 81 is of intermediate diameter, traverses circular aperture 86 in rear wall 72 and carries a fixed pair of radial blades 87 juxtaposed to the interior surface of rear wall 72. The smallest diameter segment 85 of central shaft 81 is journaled in a circular aperture 91 in front wall 71. Below aperture 86 inside housing 70 a flexible elongated reed 95 is mounted. The reed 95 has a free end 92 which extends into the radial path described by blades 87 when central shaft 81 is rotated. The opposite end 93 of reed 91 is fixed to rear wall 72 by fastening means 94. Manual rotation of steering wheel 74 causes audible impacts of rotating blades 87 upon free end 92 of flexible reed 95.

The two air chambers 101 and 102 are provided in the stern portions of hull 12 and defined by rearward portions 13*a* of bottom 13, adjacent portions of upstanding side wall 14, superimposed portions of deck 18, and front walls 103 and 104. The apertures 105 and 106 are provided in front walls 103 and 104 respectively and are interconnected by an air duct 107 formed of rigid tubing. Air duct 107 communicates with an air bulb 112 through an inlet duct 111. Upon the compression of air bulb 112 air pressure in ducts 111 and 107 and chambers 101 and 102 will rise and cause expulsion of air from chambers 101 and 102 through a plurality of apertures 121 provided in the stern portion of hull 12. Each of apertures 121 are surrounded by a rearwardly projecting tubular member 122. Air ejected through apertures 121 will tend to rise in the form of air bubbles in the wake of toy 11 as it is pushed through the water thus simulating and suggesting the jet propulsion. An air valve 131 and a water valve 132 are provided in air duct 107 to prevent influx of water into air bulb 112 and permit intake of air by air bulb 112.

The foregoing detailed description has been given for clearness of understanding only and no unnecessary limitations should be understood therefrom as some modifications will be obvious to those skilled in the art.

What is claimed and desired to be secured by Letters Patent of the United States is:

1. A tub toy comprising:

a hull including a pair of laterally spaced rearward extensions;

a hollow handle spanning the gap between said extensions to allow fluid communication therebetween;

an elevated front deck, a lower level rear deck and an instrument panel intermediate said front deck and said rear deck covering said hull;

jet propulsion means including a plurality of air tubes projecting rearwardly from said extensions;

a source of renewable air supply;

a passageway between said air supply source and said air tubes extending along said hollow handle;

valve means sealing said air supply source against influx of water from said air tubes;

bow spray generating means including a water discharge nozzle adjacent said elevated front deck, refillable water discharge means connected to said nozzle, said discharge means being selectively operable to eject water from said bow spray generating means through said nozzle, a catch basin means defined in said front deck surrounding said bow spray generating means to catch discharged water and return it to said discharge means;

sound generating means including a housing mounted on said front deck and said instrument panel, a rotatable simulated steering wheel having a central shaft rotatably supported in said housing, a mechanical sound generator responsive to rotation of said central shaft provided in said housing; and a marine life observation compartment contained in said hull having a transparent top wall and containing buoyant miniature specimens of simulated aquatic life and including port means and valve means for flooding said compartment with water ambient to said hull, a cover hingedly mounted on said hull for covering said transparent top wall.

* * * * *